United States Patent [19]

Alperin et al.

[11] Patent Number: 4,815,942

[45] Date of Patent: Mar. 28, 1989

[54] AXIALLY-SYMMETRIC, JET-DIFFUSER EJECTOR

[75] Inventors: Morton Alperin, Woodland Hills; Jiunn-Jenq Wu, Sierra Madre, both of Calif.

[73] Assignee: Elayne P. Alperin, Woodland Hills, Calif.

[21] Appl. No.: 436,639

[22] Filed: Oct. 25, 1982

[51] Int. Cl.[4] ..... F04F 5/16; F04F 5/44

[52] U.S. Cl. ..... 417/167; 60/269; 417/163; 417/170; 417/179; 417/196; 417/197; 417/198

[58] Field of Search ..... 417/151, 163, 167, 169, 417/170, 177, 179, 180, 196–198; 60/269; 239/265.17

[56] References Cited

U.S. PATENT DOCUMENTS

| | | | |
|---|---|---|---|
| 1,804,569 | 5/1931 | Taddiken | 417/180 X |
| 2,000,762 | 5/1935 | Kraft | 417/167 |
| 2,173,330 | 9/1939 | Gregg | 417/174 |
| 2,444,615 | 7/1948 | Reinhardt | 417/197 |
| 2,657,641 | 11/1953 | Lung | 417/151 |
| 3,216,653 | 11/1965 | Le Nabour | 417/197 X |
| 3,525,474 | 8/1970 | Ohain et al. | 60/269 |
| 4,332,529 | 6/1982 | Alperin | 417/54 |
| 4,473,186 | 9/1984 | Alperin | 239/8 |

FOREIGN PATENT DOCUMENTS

| | | | |
|---|---|---|---|
| 916748 | 7/1954 | Fed. Rep. of Germany | 417/197 |

OTHER PUBLICATIONS

Alperin et al., Journal of Aircraft for Dec., 1981 publication "Recent Developments of a Jet Diffuser Ejector", pp. 1011–1018.

Alperin et al., "Jet-Diffuser Ejector-Attached Nozzle Design" publication NASA CR 152361, May 1980 (entire publication).

*Primary Examiner*—Edward K. Look

*Attorney, Agent, or Firm*—Edward DaRin

[57] ABSTRACT

An axially symmetric jet difuser ejector having attached primary injection nozzles without protruding outside the ejecting structure and being spaced around the ejector inlet. The primary nozzles have been specially designed to optimize the conveyance of fluids therethrough and the flow of ingested fluids therearound. The diffuser jet nozzle is provided with a strainer to prevent clogging of the narrow diffuser jet slots.

21 Claims, 2 Drawing Sheets

AXIALLY-SYMMETRIC, JET-DIFFUSER EJECTOR

FIELD OF INVENTION

This invention relates to improved jet diffuser ejectors with emphasis on performance optimization with minimal size and cost of fabrication, to permit practical utilization as efficient thrusters, spray devices and pumps.

CROSS-REFERENCE TO RELATED APPLICATION

This application discloses an improved jet diffuser ejector from that disclosed and claimed in U.S. Pat. No. 4,332,529, granted on June 1, 1982, and the structures disclosed in the copending patent application bearing Ser. No. 367,432, and entitled METHOD AND APPARATUS FOR SPRAYING, now U.S. Pat. No. 4,473,186, granted on Sept. 25, 1984.

BACKGROUND OF INVENTION

The jet diffuser ejector disclosed in U.S. Pat. No. 4,332,529 is disclosed in the form of a rectangular configuration having a relatively short length in the direction of the thrust axis of the ejector for maximizing thrust augmentation with minimal volumetric requirements. The principal characteristic of the jet diffuser ejector disclosed in said U.S. Pat. No. 4,332,529 is that relative to conventional ejectors, it has a relatively short length in the thrust direction of the ejector with a diffusing section having relatively large angles of divergence greater than 7° to 8° so as to cause the core fluids to diffuse beyond the discharge end of the solid surface of the ejector without separation. This can cause divergence of the discharge fluids to one-half angles as large as 60° without adverse effects on performance. The wide angle, high performance and relative short length achieved by this type of ejector is primarily due to the diffusing section of the patented ejecting structure which comprises upstream and downstream solid sections and a diffuser jet. The downstream solid diffusing section has a large area ratio and terminates in a divergence angle as large as can possibly be utilized in a particular application. The diffuser jet comprises a nozzle completely surrounding the periphery and incorporated between the downstream and upstream solid diffuser surfaces to introduce a fluid jet to prevent separation of the conveyed fluids from the solid wall downstream of the jet. The diffuser jet fluid forms a jet sheet, increasing the effective diffuser area ratio and causing all the mixed fluids to diffuse beyond the solid diffuser surface.

The method and apparatus for spraying disclosed in copending patent application Ser. No. 367,432 utilizes the basic jet diffuser ejector of the type disclosed in said U.S. Pat. No. 4,332,529, as the preferred embodiment. The ejector, however, has been modified for conveying a spray substance through the ejecting structure in combination with the usual mixed core fluids. For this purpose, the disclosed ejector has a circular cross-sectional configuration, and is provided with a plurality of means for introducing a spray substance into the ejector.

The problems associated with the achievement of smooth, unseparated flow in the corners and along the lateral sides of the rectangular ejector as originally developed and disclosed in U.S. Pat. No. 4,332,529 is resolved by utilizing flat nondiverging solid diffuser ends. Later designs were developed for use in aiding and avoiding the end problems and permitting the use of diverging ends. These prior art techniques have been published in the Journal of Aircraft in an article entitled "Recent Developments of a Jet-Diffuser Ejector", by Morton Alperin and Jiunn-Jenq Wu, in December, 1981, pages 1011 through 1018. As noted in said Journal of Aircraft publication, the developments were disclosed at a technical meeting of the American Institute of Aeronautics and Astronautics in January 1980, in Pasadena, Calif. To adapt the jet diffuser ejector of the type disclosed in U.S. Pat. No. 4,332,529 to the vertical takeoff of high-speed aircraft it required that the primary nozzles for the ejector be stowed during the high-speed portion of flight to avoid excessive drag. A rectangular jet diffuser ejector having the attached nozzle design was also disclosed in the publication of Alperin and Wu entitled "Jet Diffuser Ejector-Attached Nozzle Design", NASA CR152361, May 1980.

SUMMARY OF THE INVENTION

The present invention comprises an axially-symmetric jet diffuser ejector which may be used for thrust augmentation of airborne, waterborne, or submarine propulsion systems; jet pumps; aeration of water treatment systems and spray nozzles, among others. The improvements in the axially symmetric configuration of the jet diffuser ejector of the present invention as contrasted with the prior art structures, discussed hereinabove, relate to the improvements for achieving optimal performance, simplicity of fabrication and maintenance of the ejecting device, including minimizing the weight. The simplicity of maintenance includes the use of a strainer for avoiding clogging of the narrow diffuser jet slot by extraneous matter which may be present in the energized fluid conveyed thereto, and which may be easily accessed for maintenance and cleaning. The ejecting structure is advantageously defined not only to operate in the usual method by inducing or ingesting ambient fluids into the ejecting structure to be conveyed therethrough, but also to ingest additional fluids injected into the ejecting structure, either at the inlet of the ejecting structure or downstream of the primary nozzles. The primary nozzle means of the ejector is constructed and defined to be attached to the inlet section of the ejecting structure and yet provide efficient conveyance of the pressurized fluid therethrough from the fluid source and an efficient passage of the induced fluid flow around the exterior of the nozzle means. The energized fluid source may be conveniently coupled to a single plenum chamber attached externally of the ejecting structure and communicating with the primary and diffusing nozzles. The plenum chamber may be divided internally by apparatus required for straining or removing particles which could block the narrow diffuser jet slot, but is essentially only one single plenum chamber for ease of fabrication.

From a broad apparatus standpoint, the present invention broadly comprehends an axially-symmetric ejecting structure having a converging inlet section and a diffusing section defined downstream from the inlet section for diffusing the fluids passing therethrough to recover the kinetic energy of the mixed fluids. The fluid injecting structure includes a plurality of primary injection nozzle means for injecting a pressurized fluid into the inlet section for the ejecting structure. The primary injection nozzle means are attached to the ejecting structure and are arranged in the preselected spaced relationship around the inlet section preferably without protruding outside the ejecting structure, and permitting fluids to be ingested from outside the ejecting structure. The primary injection nozzle means are further characterized as injecting a pressurized fluid into the inlet section for mixing with the ingested fluids and injecting the pressurized fluid in the approximate direction of the flow of the ingested fluids into the ejecting structure. The ejecting structure further includes means for supplying a pressurized fluid to the primary nozzle means.

For a more specific apparatus standpoint, the invention comprises an axially-symmetric ejecting structure having a converging inlet section and a diffusing section, downstream from the inlet section and the throat of the ejecting structure, for diffusing the core fluids. A plurality of primary injection nozzle means for injecting a pressurized fluid into the inlet section for the ejecting structure is provided. The primary injection nozzle means are attached to the ejecting structure and are arranged in a preselected spaced relationship around the inlet section, preferably without protruding outside the ejecting structure and permitting a flow of ambient fluid to be induced into the ejector through the spaces between the primary injection nozzle means to be mixed with the fluid injected into the ejector by the nozzle means. The primary injection means is further characterized as injecting a pressurized fluid in the approximate direction of the flow of the induced fluids to be mixed therewith to thereby provide the mixed core fluids to be conveyed through the ejecting structure. A diffusing section for the ejector is constructed and defined to comprise a solid upstream diverging section and a solid downstream diverging section having a large fluid outlet to fluid inlet area ratio in a relatively small length in the direction of thrust through the provision of the large divergent angle at the termination of the solid downstream section. The diffusing section includes a diffuser jet means arranged intermediate the upstream and downstream diffusing sections for introducing a thin, high-speed jet stream completely surrounding the periphery of the ejecting structure and flowing into the diffusing section along the diffuser solid wall to prevent separation in the downstream diffusing section between the mixed core fluids and the diffuser wall and to prevent separation between the diffuser jet stream and the core fluids, and to cause the core fluids to diffuse beyond the end of the downstream diffusing section. The ejecting structure further includes means for supplying a pressurized fluid to the primary injection means and the diffuser jet means.

BRIEF DESCRIPTION OF THE DRAWINGS

These and other features of the present invention may be more fully appreciated and considered in the light of the following specification and drawings, in which.

DETAILED DESCRIPTION OF THE PREFERRED EMBODIMENT

Figure 1:
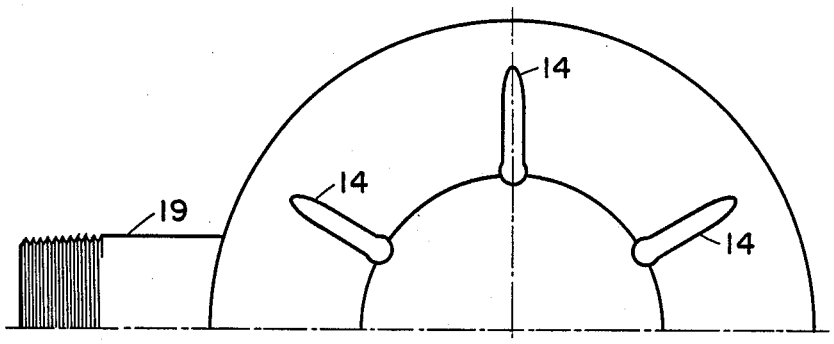
FIG. 1 is a partial, front end elevational view of the axially-symmetric jet diffuser ejector embodying the present invention.

For the purposes of the present invention, certain conventional terms are being defined herein since they have meaning for the purposes of the invention that differ from conventional usage. The definitions as applied to these terms are as follows:

FLUIDS—Fluids comprise liquids, gases, mixtures of liquids and gases; or solid particles in combination with a liquid or a gas for conveyance through an ejecting structure.

EJECTOR—An axially symmetric ejecting structure per se which accepts a portion of an energized fluid which is injected from its primary nozzles and causes it to mix with a stream of fluid which has been induced to flow or is captured from the environment, or mixes with ingested fluid from an external source, and to discharge the resulting mixed fluids into a receiver which may be the environment or a receptacle suitable for accepting the discharged fluid.

THROAT—The section of the ejector duct immediately downstream of the converging inlet section where the duct cross-section is a minimum.

Now specifically referring to the drawings, the axially-symmetric jet diffuser ejector 10 will be described in detail. The axially-symmetric jet diffuser ejector 10 has been constructed and subjected to tests wherein the energized fluid was air, compressed to gauge pressures in the range of 3 to 30 pounds per square inch (psig) at ambient temperature. The disclosed ejecting structure is based on the optimal design derived from these tests for the axially-symmetric jet diffuser ejector 10. These optimal designs will vary from those observed in the tests when the ejector 10 is operating under different conditions, as may be appreciated by those skilled in the art.

Figure 2:
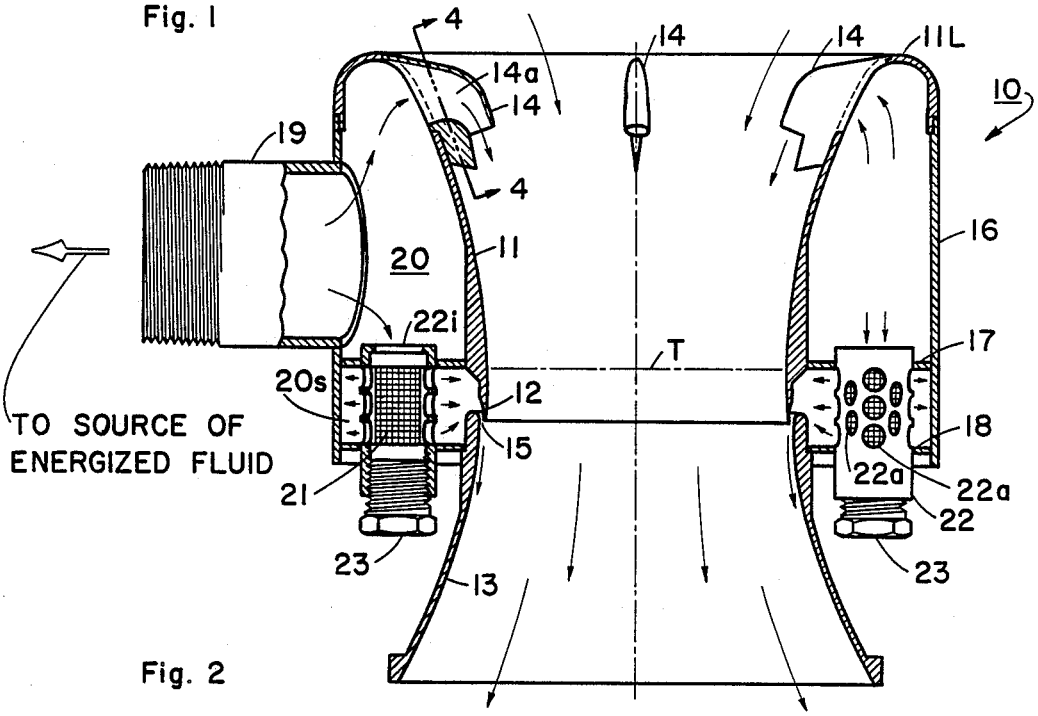
FIG. 2 is a cross-sectional view, with portions shown in elevation of the jet diffuser ejector of FIG. 1.
Figure 3:
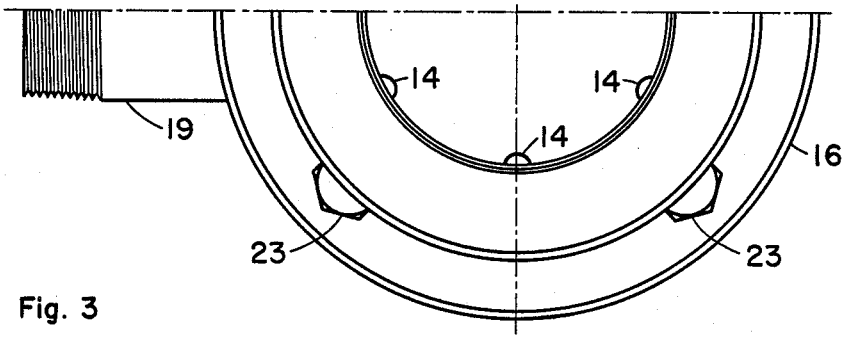
FIG. 3 is a partial, rear end elevational view of the ejector of FIG. 2.

The axially-symmetric jet diffuser ejector 10 comprises an inlet section 11, and an upstream solid diffuser 12 illustrated as being constructed integral with the inlet 11. The ejector further includes a downstream solid diffuser 13. The primary injection nozzle means 14 is attached to the ejector 10 at the inlet 11 and the diffusing jet nozzle means 15 are defined as a continuous slot between the upstream solid diffuser 12 and the downstream solid diffuser 13, as illustrated in FIG. 2. The ejecting structure 10 is provided with a frame 16 for attaching the major elements of the ejector 10 thereto. A pair of plates 17 and 18 are attached to the frame 16 at the inlet section 11 and the downstream solid diffuser section 13 of the ejector 10 for securing them together. The major elements may be attached by conventional fastening techniques which provide adequate seals or by brazing or welding processes. The primary injection nozzles 14 may be brazed, welded, or integrally formed with the inlet 11 for the ejector 10.

The frame 16 is attached to the axially-symmetric ejector 10, and is constructed to define a plenum chamber 20 for receiving energized fluid therein for conveyance through the primary injection nozzle 14 and the diffuser jet nozzle 15. For this purpose, the frame 16 includes a conventional coupling element 19 that may be coupled to a conduit carrying energized, pressurized fluid from a source (not shown). The energized fluid received by the conduit 19 is conveyed into the plenum chamber 20, and from there it may go into a second portion 20*s* of the plenum chamber 20 defined between the plates 17 and 18 for conveyance to the diffuser jet nozzle 15. In this instance, the second portion 20s of plenum chamber 20 includes a strainer 21 within a housing 22 therefor secured between the plates 17 and 18, as illustrated. The housing 22 is provided with a plurality of apertures 22a which function as exit apertures for the pressurized fluid entering into the strainer housing 22 by means of the fluid inlet port 22i. In this manner the energized fluid from the plenum chamber 20 is constrained to flow into the strainer housing 22 through the strainer 21 and out through the exit apertures 22a so as to remove any foreign material that may be present in the energized fluid from entering into the diffuser jet nozzle 15. The strainer housing 22 is also provided with a plug 23 which is threaded into the end of the housing 22 opposite from the inlet aperture 22i. The plug 23 may be readily removed from the housing 22 to clean out the strainer 21. The pressurized fluid in the plenum chamber 20 goes directly through a suitable aperture in the wall of the inlet 11 into the primary injection nozzles 14. The plenum chamber 20, as well as the chamber 20s for the diffuser jet nozzles, are in the described manner arranged to convey fluid under pressure to each of the primary injection nozzles 14 and the diffuser jet slot 15. In the embodiment illustrated, six primary injection nozzles means 14 are illustrated in a preselected spaced relationship around the inlet 11. In the same embodiment, four strainers 21 are arranged in a preselected spaced relationship adjacent to the continuous diffuser jet slot 15.

The optimal location and orientation of the primary jet discharge in an axially-symmetric ejector differ considerably from those of a rectangular or two-dimensional ejector. These differences result from the inherent geometrical and aerodynamic relationships of the area and mass flow variations with distance from the centerline, resulting from the curvature of the axially-symmetric configuration.

In general, the flow velocity is greater near the surface of the inlet of an ejector than near its centerline. Further, in an axially-symmetric ejector, the area of the flow channel increases with the square of the radius, in contrast to the linear dependence of area with distance from the centerline of a rectangular ejector. Thus, the mass flow distribution is more concentrated near the surface of an axially-symmetric ejector than it is in a rectangular ejector.

The primary jet discharge of an axially-symmetric ejector has been found to provide optimal ejector performance when located at about 80% of the radial distance from the centerline to the solid surface, and within 40% of the axial distance between the inlet lip 11L and the throat T of the ejector 10. This empirical finding will vary, depending upon details of the inlet shape, the pressure and temperature of the fluid, and actual optimization must be established by realistic testing.

From the above considerations, it is evident that the location of the primary jet discharge must be closer to the inlet surface of the ejector when the ejector is axially-symmetric than when the ejector is rectangular.

Orientation of the primary jet discharge has been found to be optimized when the discharge is in the approximate direction of the local secondary flow. Large cross-flow between the primary and secondary flow is not desirable. Under the conditions of the above described tests, the optimal discharge angle for the primary jet of an axially-symmetric ejector was determined to be about 70° to the normal to the thrust axis for the inlet duct shape illustrated in FIG. 2. This angle will vary for optimal performance under other operational and design conditions.

The diffuser jet nozzle 15 must be located in the region where the upstream diffuser has not diverged sufficiently to result in flow separation. In general this would imply the location to be at the downstream end of the ejector's minimum section, before any diffusion occurs. However, it is also important to minimize the length of solid surface 13 downstream of the diffuser jet nozzle 15, in order to minimize dissipation of momentum flux, associated with the diffuser jet flow, due to skin friction. Thus, the final selection of the diffuser jet nozzle location must be a compromise between the requirement for minimizing the skin friction along the surface of the downstream solid diffuser 13 and the avoidance of separation in the upstream solid diffuser 12.

The ejector duct for the ejector 10 which includes the inlet section 11, the upstream solid diffuser 12 and the downstream solid diffuser 13, should be configured in a manner which avoids flow separation, or excessive pressure gradients. Due to the complexity of the flow processes within the ejector 10, analytical evaluation of the pressure gradients for any given surface configuration can only be accomplished by an approximate manner, and final selection of the most effective design must be verified by experiments.

The results of the previously described analytical and experimental investigation indicated that the maximum pressure gradient which could be tolerated without flow separation, depends upon the momentum flux from the diffuser jet 15. Thicker diffuser jet nozzle slots or large plenum pressures provided larger momentum flux from the diffuser jet and could more effectively suppress flow separation. However, it is desirable to minimize the diffuser jet momentum flux for achievement of high performance of the ejector 10. Thus, some care must be exercised in selection of the surface configuration, so that separation can be avoided within a short diffuser, with minimal diffuser jet momentum.

Figure 4:
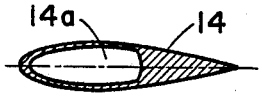
FIG. 4 is a cross-sectional view taken along the line 4—4 of FIG. 2.

The primary nozzles 14 inject about 40% to 90% of the total energized fluid into ejector 10. It has been found that these nozzles must provide efficient passage of the energized fluid from the plenum 20 to the desired location and orientation of the discharge from the nozzle 14, as well as efficient passage of the induced or secondary flow around the exterior configuration of the primary injection nozzles 14. Accordingly, an important factor relative to the configuration of the primary injection nozzle 14 is the design of the internal duct and the external fairing for these elements. To minimize the internal flow losses of the internal ducts 14a for the primary nozzles 14, a duct 14a which is continuously converging in the flow direction is desirable, i.e., the area decreases from the point of communication with the plenum chamber 20 to the discharge point and which duct has a circular configuration at its discharge point. The external surfaces of the primary nozzles 14 should be streamlined in the flow direction. For this purpose, air foil shapes, as illustrated in FIG. 4, can be utilized as long as they provide the desired streamline. The selection of the most advantageous airfoil shape and thickness ratio must be made after proper consideration of the matching of the internal duct and the external fairing.

Now referring back to the principle components of the diffuser section of the ejector 10, and in particular the upstream solid portion 12 and downstream solid portion 13, and its continuous diffuser jet nozzle 15 between the upstream and downstream solid portions. The upstream portion of the diffuser section or the portion 12 is essentially an axially symmetric, slightly diverging lip, which in the drawing in FIG. 2 diverges to a small increment of cross-section compared to the area of the throat for the ejector 10.

The downstream solid portion 13 of the diffuser section is a diverging surface of revolution whose divergence angle increases progressively from near zero to angles as large as 60° with respect to the axis of symmetry of the ejector 10. This results in an overall length of the diffuser which can be much smaller than the length of conventional diffusers of the same area ratio.

The diffuser jet 15 is responsible for the avoidance of flow separation in the downstream solid diffuser 13 and can actually create a diverging fluid envelope surrounding the effluent flow, thereby increasing the effective diffuser area ratio to values in excess of the geometrical area ratio of the solid surfaces.

With the modifications to the basic jet diffuser ejector described in U.S. Pat. No. 4,332,529 in mind, it should be recognized that the general operation of the ejector 10 is similar to that disclosed in said U.S. Pat. No. 4,332,529. The modifications result from the use of an axially-symmetric configuration which affects the flow patterns and optimal geometry as described hereinabove. The primary injection nozzles 14 inject the energized fluid into the inlet 11 of the ejector 10 and induce or ingest a fluid flow from the environment. These fluid flows are mixed as they flow towards the diffusing end. The jet diffuser nozzle means 15 injects a thin, high-speed jet stream completely surrounding the periphery of the downstream ejecting structure 13 which flows into the diffusing section between the mixed core fluids and the diffuser wall and causes the core fluids to diffuse beyond the end of the downstream diffusing section. The diffusing of the core fluids beyond the end of the downstream diffusing section results from the large divergent angle for the solid downstream section and whereby a large fluid outlet to fluid inlet area ratio in a relatively small length in the direction of thrust is provided.

Figure 5:
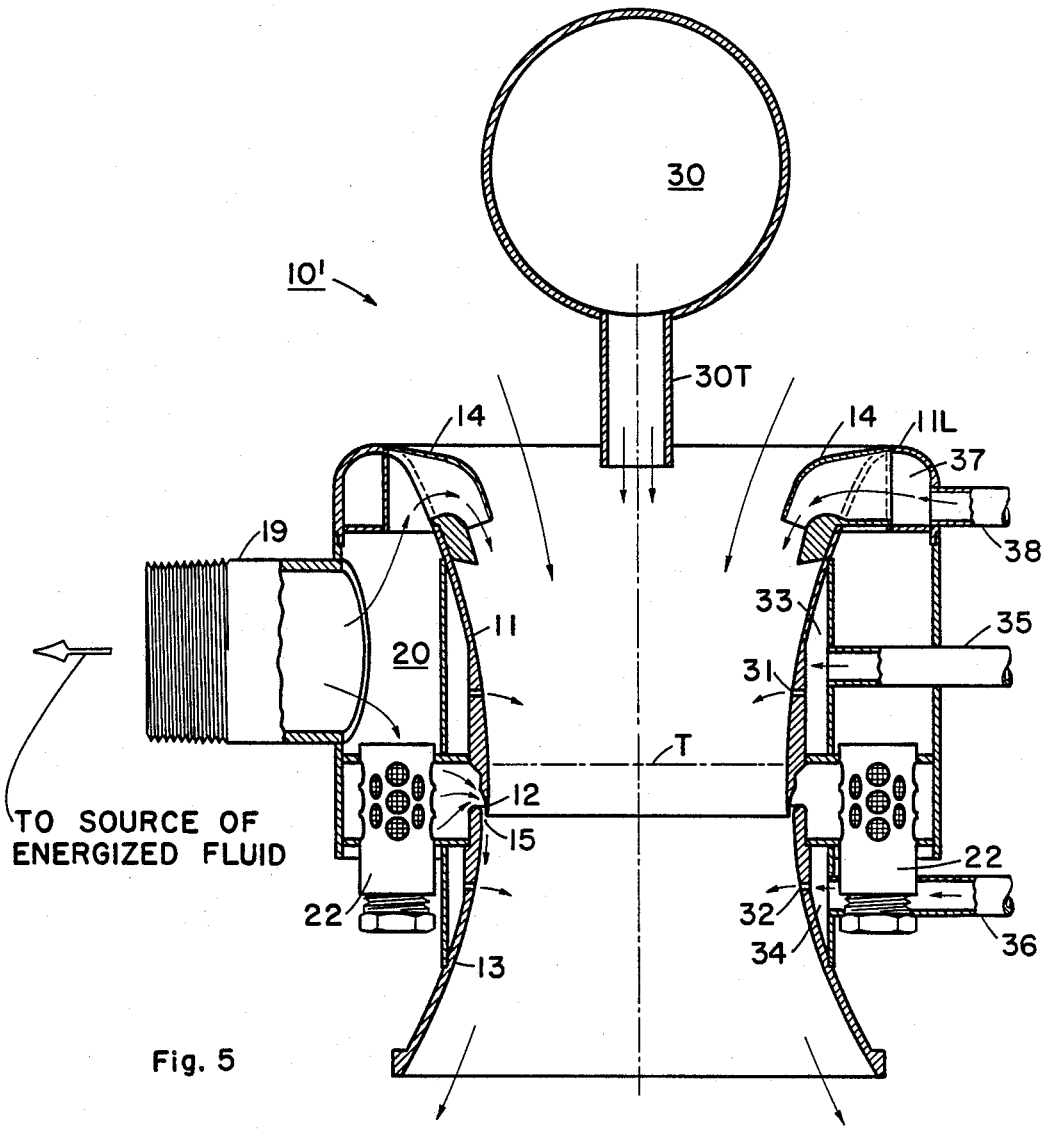
FIG. 5 is a cross-sectional view, with portions shown in elevation, of the axially symmetric jet diffuser ejector of FIGS. 1–4 adapted for ingesting fluids external of the ejector into the flow field of the ejector.

Now referring to FIG. 5, another embodiment of an axially-symmetric jet diffuser ejector $10^1$ modified for use as a spray nozzle or a water aeration device will be described. The ejector $10^1$ is basically the same as the ejector 10 of FIGS. 1–4 but includes means for injection or ingestion of fluids from external sources into the flow field of the ejector in various modes. The fluids to be injected or ingested into the ejector $10^1$ may be pressurized or may be ingested as a result of the reduced pressure in the flow field at the point of injection or ingestion relative to the pressure at the source of the injected or ingested fluid. The various means for injection or ingestion illustrated in FIG. 5 may be utilized individually or in combination. The modification of an ejector for use as a spray nozzle is described and claimed in the aforementioned patent application bearing Ser. No. 367,432. The injection or ingestion of fluids from external sources into the flow field of the ejector $10^1$ is illustrated in FIG. 5 by means of auxiliary cavities and special external equipment.

One of the means for injection or ingestion of fluids other than the fluids injected by the primary and diffusing nozzles and the fluid induced into the ejector $10^1$ is by means of a plenum 30 coupled to a source of pressurized fluid (not shown) and having a fluid delivery tube 30T. The plenum 30 is illustrated as arranged in axial alignment with the axis of the ejector $10^1$ but spaced outwardly a preselected distance from the inlet 11 for the ejector. The fluid delivery tube 30T for the plenum 30 may extend into the ejector $10^1$ to any point extending between outside the inlet lip 11L to the throat T of the ejector. With these variations in spacing the end of the delivery tube 30T may vary in pressure at the delivery end of the tube 30T from approximately ambient pressure to the reduced pressure which exists at the throat T of the ejector $10^1$. With this means for injection or ingestion, fluids may be injected from a pressurized source or from an ambient pressure source such as the air from the atmosphere. If the ejector $10^1$ is operated submerged in a body of water such as a tub or pool, water from the body of water may be injected or ingested into the ejector $10^1$.

An alternative means of injection or ingestion that may be utilized with the plenum 30 or independently thereof comprises modifying the walls of the ejector $10^1$ downstream of the primary injection nozzle means 14 by the provision of orifices 31 and 32. The orifice 31 is located at a preselected location between the primary injection means 14 and the diffuser jet 15 while the orifice 32 is located below the diffuser jet 15 in the diffuser wall 13. For use with the orifices 31 and 32 individual plenums 33 and 34 are respectively provided adjacent the outer wall of the ejector inside the plenum 20. The plenum 33 is in communication with the orifice 31 and a fluid supply conduit 35 coupled to the source of fluid (not shown) to be injected or ingested into the ejector $10^1$. The plenum 34 is defined below the plate 18 and adjacent the strainer housing 22 in communication with the orifice 32. The plenum 34 is also provided with a supply conduit 36 connected to a fluid source (not shown). The pressures at the orifices 33 and 34 are below ambient pressure whereby the fluids introduced into the ejector $10^1$ may be injected or ingested by means of the orifices either from an ambient pressure source or from a pressurized source.

A further modification of the ejector $10^1$ comprises the provision of a plenum chamber to supply fluid to selected primary injection means 14. This modification comprises the plenum chamber 37 shown isolated from the plenum chamber 20 and in communication with the primary injection means 14 and a supply conduit 38 coupled to a fluid source (not shown).

With the above modifications for the ejector $10^1$ in mind, it should be noted that the ejector $10^1$ can be used in hydrotherapy jet applications. For this latter application, the primary injected fluid and the induced fluids are liquids and environmental air may be used as the fluid injected or ingested into the orifices 31 or 32 via the plenums 33 or 34. Similarly, for use of the ejector $10^1$ in a water treatment system, the induced fluids may be injected or ingested air or air may be injected from the primary nozzle means 14 while the induced fluid may be the water.

We claim:

1. An ejecting structure comprising an axially symmetric ejecting structure having a converging inlet section and a diffusing section downstream from the inlet section and throat of the ejecting structure for diffusing the core fluids, a plurality of primary injection nozzle means for injecting a pressurized fluid into the inlet section of the ejecting structure, said primary injection nozzle means being attached to the ejecting structure and being arranged in a preselected symmetrically spaced relationship around the inlet section without protruding outside the ejecting structure and permitting a flow of ambient fluid to be induced into the ejector through the spaces between the primary injection nozzle means to be mixed with the fluid injected into the ejector by said nozzle means, said primary injection nozzle means being further characterized as arranged at a preselected acute angle to the normal to the thrust axis for injecting a pressurized fluid at a point radially spaced from the ejector structure and in the approximate direction of the flow of the induced fluid to be mixed therewith to thereby provide the mixed core fluids to be conveyed through the ejecting structure, the diffusing section of the ejector is constructed and defined to comprise a solid upstream diverging section and a solid downstream diverging section having a large fluid outlet to fluid inlet area ratio in a relatively small length in the direction of thrust through the provision of a divergence angle greater than 7 or 8 degrees and as large as 60 degrees relative to the axis of the ejector for the solid downstream section, the diffusing section including diffuser jet means arranged intermediate the upstream and downstream diffusing sections for introducing a thin, high speed jet stream completely surrounding the periphery of the ejecting structure and flowing into the diffusing section along the diffuser solid wall to prevent separation in the downstream diffusing section and to cause the core fluids to diffuse beyond the end of the downstream diffusing section to thereby provide said large area ratio in a relatively small length of the short, solid, diffusing section, and means for supplying a pressurized fluid to the primary injection means and the diffuser jet means.

2. An ejecting structure as defined in claim 1 wherein the diffuser jet means comprises continuous jet slot nozzle means constructed and defined in the periphery of the axially symmetric ejecting structure.

3. An ejecting structure as defined in claim 1 or 2 wherein the means for supplying pressurized fluid to the primary injection means and the diffuser jet means comprises plenum chamber means constructed and defined integrally with the outside of the ejecting structure and in communication with the primary injection means and the diffuser jet means for supplying a pressurized fluid thereto, said plenum chamber means being adapted to be coupled to a source of pressurized fluid.

4. An ejecting structure as defined in claim 2 wherein the means for supplying pressurized fluid to the primary injection means and the diffuser jet means comprises plenum chamber means constructed and defined integrally with the outside of the ejecting structure and comprising two interconnected plenum chambers for individually supplying pressurized fluid to the primary injection means and the diffuser jet means from a single source of pressurized fluid, the interconnection between the plenum chambers including means for removing solid particles from the fluid conveyed to the diffuser jet means.

5. An ejecting structure as defined in claim 1 including means for injecting a further fluid into the flow field of the mixed core fluids for the ejecting structure and arranged in a preselected spaced relationship with the inlet section and the primary injection nozzle means.

6. An ejecting structure as defined in claim 1 wherein the orientation of the primary jet discharge is approximately 70 degrees to the normal to the axis of symmetry of the ejecting structure.

7. An ejecting structure as defined in claim 1 or 6 wherein the external surfaces of the primary nozzle means are constructed and defined to be streamlined in the direction of the induced flow.

8. An ejecting structure as defined in claim 1 or 6 wherein each of the primary injection nozzle means are constructed and defined internally to be continuously converging in area from the fluid inlet to the fluid outlet of the nozzle means.

9. An ejecting structure as defined in claim 1 or 6 wherein each of the primary injection nozzle means are constructed and defined internally to be continuously converging :,n area from the fluid inlet end to the fluid outlet end of the nozzle means and having its external surface streamlined in the direction of the fluid flow.

10. An ejecting structure as defined in claim 1 wherein said primary injection nozzle means comprises six nozzle means.

11. An ejecting structure as defined in claim 1 including additional means for injecting a further fluid into the mixed core flow of the ejecting structure be mixed and conveyed therewith through the ejector.

12. An ejecting structure as defined in claim 11 wherein said additional means for fluid injection comprises additional means arranged outside the inlet of the ejecting structure for conveying a fluid into the ejecting structure to be ingested with the mixed fluids.

13. An ejecting structure as defined in claim 11 wherein said additional means for fluid injection comprises means for introducing a fluid into the ejecting structure through aperture means in the walls of the ejecting structure downstream of the primary injection means.

14. An ejecting structure as defined in claim 1 wherein said means for supplying pressurized fluid to the primary injection means and the diffuser jet means includes strainer means coupled to receive and strain the pressurized fluid for the diffuser jet means to prevent clogging the diffuser jet means.

15. An ejecting structure as defined in claim 14 wherein said strainer means are constructed and defined to be readily removed.

16. An ejecting structure as defined in claim 1 including additional means for supplying additional fluid to preselected primary injection nozzle means.

17. An ejecting structure comprising an axially symmetric ejecting structure having a converging inlet section and a diffusing section defined downstream from the inlet section for diffusing the fluids passing therethrough to recover the kinetic energy of the mixed fluids, a plurality of primary injection nozzle means for injecting a pressurized fluid into the inlet section for the ejecting structure, said primary injection nozzle means being attached to the ejecting structure and being arranged in a preselected, symmetrically spaced relationship around the inlet section without protruding outside the ejecting structure and permitting fluids to be ingested from the outside of the ejecting structure through the spaces between the primary injection nozzle means to be mixed with the fluid injected into the ejector by said nozzle means, said primary injection nozzle being further characterized as injecting a pressurized fluid into the inlet section for mixing with the ingested fluids and arranged at a preselected acute angle to the normal to the thrust axis for injecting a pressurized fluid at a point radially spaced from the ejector structure and in the approximate direction of the flow of the ingested fluids into the ejecting structure, and means for supplying a pressurized fluid to said primary nozzle means.

18. An ejecting structure as defined in claim 17 wherein said supply means comprises single duct means for supplying said primary nozzle means.

19. An ejecting structure as defined in claim 18 wherein each of said primary injection means are constructed and defined with duct means defined to be continuously converging in area from the inlet of the nozzle means to the discharge of the nozzle means for efficiently conveying the pressurized fluid therethrough from said supply means.

20. An ejecting structure as defined in claim 17 wherein the external surfaces of the primary injection nozzle means are defined to be aerodynamically streamlined in the direction of the flow direction of the ingested fluids.

21. An ejecting structure as defined in claim 17, wherein the supply means comprises plenum chamber means secured to said ejecting structure in fluid communication with each of said primary injection nozzle means and means adapted to be coupled to a source of energized fluid to be conveyed to said injection nozzle means through said plenum chamber means.

* * * * *